United States Patent [19]

Garner et al.

[11] 4,429,520

[45] Feb. 7, 1984

[54] APPARATUS FOR STRANDING AT LEAST TWO WIRES TOGETHER

[75] Inventors: John N. Garner, Kingston; Jean M. Roberge, Pointe Claire, both of Canada

[73] Assignee: Northern Telecom Limited, Montreal, Calif.X

[21] Appl. No.: 413,176

[22] Filed: Aug. 30, 1982

[51] Int. Cl.[3] ..... H01B 13/04

[52] U.S. Cl. ..... 57/293; 57/18; 57/294; 57/314

[58] Field of Search ..... 57/3, 6, 9, 13, 14, 57/18, 293, 294, 314, 332, 344–349

[56] References Cited

U.S. PATENT DOCUMENTS 3,847,190 11/1974 Forester ..... 57/293 X 3,910,022 10/1975 Reed ..... 57/293

4,325,214 4/1982 Zuber ..... 57/293

4,359,860 11/1982 Schleese et al. ..... 57/293

*Primary Examiner*—John Petrakes

*Attorney, Agent, or Firm*—R. J. Austin

[57] ABSTRACT

Apparatus for stranding two or more wires together comprising a wire guide means extending in a wire pass direction to a twisting station, the guide means held against rotation about an axis at its upstream end and being rotationally flexible to be torsionally twisted by a rotatable twisting means in the twisting station connected to the downstream end of the guide means. A wire separation tube extends from the twisting means along a fixed curved path section to a stranding station to prevent wires stranding together until they reach the stranding station. The separation tube is rotatable about an axis coinciding with the fixed curved path section and has flexibility to enable the tube to be maintained in its curved configuration along the path with torsional rigidity to avoid build-up and retention of twist.

9 Claims, 4 Drawing Figures

APPARATUS FOR STRANDING AT LEAST TWO WIRES TOGETHER

This invention relates to apparatus for stranding at least two wires together to form a wire unit.

It is known that the stranding of wires together offers physical and electrical advantages when the wires are individually insulated conductors as used in communications or other electrical systems. For example, the stranding of pairs or units of wires as used in telephone systems improves electrical characteristics such as reducing cross-talk.

Conventionally, to continuously strand wires together in the same direction requires a heavy, rotatable construction as the wire spools for feeding wire into the apparatus must also revolve about the machine axis. The excessive weight of the construction limits the operational speed. In order to avoid the rotation of the spools, a periodically reversing stranding operation is performed upon the wires and, as it is desirable to strand long lengths of wires in each direction, accumulators become necessary.

In order to overcome problems with known stranding apparatus, simpler apparatus has been devised to give a periodic reverse stranding operation. This simpler apparatus as described in U.S. Pat. No. 3,910,022 granted Oct. 7, 1975 in the name of Phillip John Reed and entitled "Apparatus for Stranding Wires" involves the use of a tubular member, one end of which is held stationary and the other torsionally twisted first in one direction and then the other around its longitudinal axis. Dividers positioned along the member divide the tube passage into separate paths for wires passing down the member. A twisting means at the downstream end of the tubular member, twists the member by rotating the downstream end of the member for a predetermined number of revolutions, first in one direction and then the other, to torsionally twist the member in reversing manner. A twist is imposed upon each wire by the twisting means and this twist causes the wires to strand together along their lengths as the wires emerge from the twisting means.

In U.S. Pat. No. 4,325,214 granted Apr. 20, 1982, in the name of Bretislav Pavel Zuber, and entitled "Apparatus for Stranding Wire", the tubular member is replaced by an elongate member which is held stationary at an upstream end and is rotatable at its downstream end for twisting it. The elongate member has a plurality of wire guiding elements extending radially outwards from it, each element having wire guiding holes whereby the wires are threaded through the holes from guiding element to guiding element while being located outwards from the elongate member.

In another patent application Ser. No. 413,179 in the names of John Nicholas Garner and Jean Marc Roberge filed concurrently with this present application and entitled "Stranding Wires", there is described a further alternative to the constructions covered by U.S. Pat. Nos. 3,910,022 and 4,325,214. In the application entitled "Stranding Wires", apparatus for stranding wires comprises at least two tubes each defining a passage for wire, the tubes being rotatably flexible about a common axis to torsionally twist the tubes together around the axis to enable each of the wires to be given a twist by the twisting means while the tubes prevent the wires from twisting together. The tubes are prevented from moving towards or away from each other during the twisting operation and a resilient means is used at one end of the tubes to place the tubes continuously in tension and to allow for end movement of the tubes as the tubes change in effective length during each twisting and untwisting operation. The wires strand together to form a wire unit immediately they pass downstream from the twisting means.

A problem arises where it is found to be necessary to strand wires together at a position not only downstream from the twisting means but also out of alignment with the twisting means. In this case, it is necessary for each of the wires to be moved at an angle from the twisting means to the downstream stranding station. There may be such a requirement for change in direction of the wires in apparatus in which a plurality of the elongate or tubular members are to be used in an apparatus for imposing twist into wires to be formed into a plurality of stranded pairs during the manufacture of a cable core unit. In such an arrangement, it can be seen that it would be necessary to cause the wires to converge downstream of the twisting means so that immediately after the stranding of the wires into pairs, the stranded wire pairs are together to form the core unit.

The present invention concerns an apparatus and a method of stranding wires which overcomes the above problem.

Accordingly, the present invention provides apparatus for stranding at least two wires together comprising:

wire guide means extending downstream in a wire pass direction to a twisting station to define individual feed paths for wires and prevent the wires from twisting together as they move along the guide means to the twisting station, a twisting means in the twisting station and connected to the wire guide means, the twisting means having means to rotate it alternately, in one direction and then the other, for a plurality of revolutions to rotate the wire guide means at the twisting station and place a rotational twist in the guide means alternately in one direction and then the other about a longitudinal axis of the guide means, a stranding station downstream along the feedpaths from the twisting station with at least a section of the feedpaths the wires being curved and of fixed orientation between the twisting and the stranding stations, and means extending between the twisting and stranding stations to prevent the wires, after passage through the twisting means, from stranding together before they reach the stranding station, said stranding prevention means comprising a wire separation tube which is curved to extend along the fixed curved section of path and defines the individual feed paths for the wires, said separation tube being rotatable around an axis of rotation which coincides with the fixed curved path section, and with a rotational speed equal to that and in the same direction as the twisting means, and the tube having flexibility to enable the tube to be maintained in its curved configuration along said fixed curved path section and torsional rigidity to avoid build-up and retention of twist.

In use of the above apparatus, because the separation tube is maintained in its curved configuration, then the wires passing through the tube are maintained separate from each other whereby stranding does not take place along the curved section of the feedpaths. Hence, the wires are prevented from stranding together between the twisting station and the stranding station.

To maintain the separation tube in its fixed position along the curved section of feedpaths, it is desirable to mount the separation tube in a bearing in a support frame through which the tube passes. The frame may lie at any angle to the direction of the tube at the position at which the tube passes through the frame.

The separation tube may be formed with two separate passages along its length. However, it may be difficult to rotate the tube about its own axis while maintaining it fixed along the curved section of path if it has a cross-section which has two passages, because of the stiffness of the material. It is desirable, therefore, that the separation tube has a single passage and feedpath separation means spaced apart along it to separate the passage into the feedpaths at the location of said separation means only. Hence, the separation tube is a simple tube construction. It is found that with separation means spaced apart along the tube in this manner, they suffice to maintain the wires separate from each other, i.e. they prevent stranding of the wires from one end of the tube to the other. In a preferred arrangement, the feedpath separation means are disposed solely at each end portion of the tube. Hence it is a simple matter to locate the separation means within the end portions.

The above apparatus is particularly useful when combined with a plurality of other similar apparatus to form other apparatus for stranding together a plurality of units of wires, each unit comprising at least two wires twisted together. In this other apparatus, a plurality of twisting means for the different units are spaced apart. Wire separation tubes for the different units curve along their own fixed curved sections of paths and converge to have downstream ends adjacent to one another to present all of the twisted wires in adjacent positions at the stranding station to enable the wire units to be stranded together to form a core unit. Such combined apparatus is described in patent application Ser. No. 413,175 in the names of John Nicholas Garner, Jean Marc Roberge and Oleg Axiuk filed concurrently with this present application and entitled "Forming Cable Core Units".

One embodiment of the invention will now be described by way of example, with reference to the accompanying drawings in which.

Figure 1:
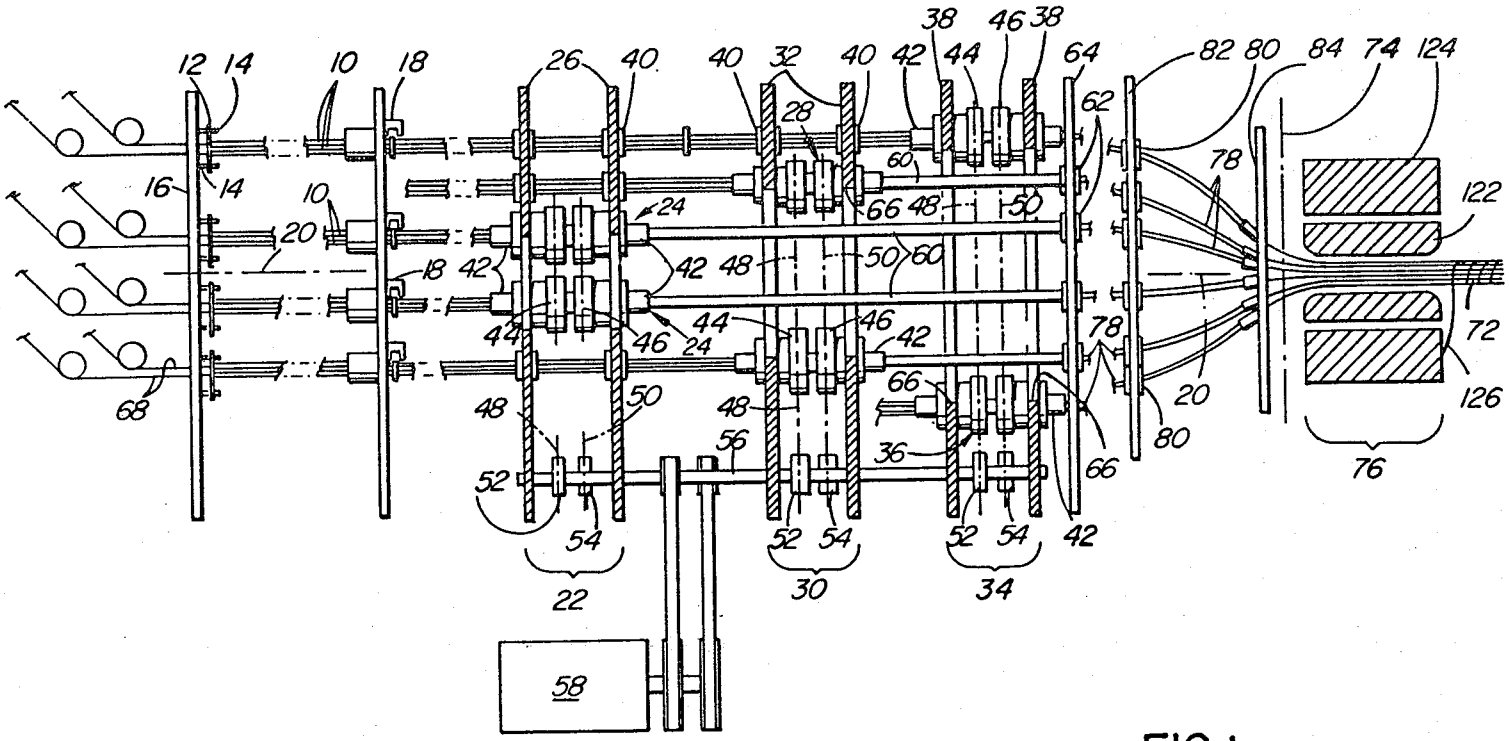
FIG. 1 is a side elevational view partly in cross-section of apparatus for forming insulated conductors into stranded pairs and for forming a cable core unit from the stranded pairs.

The apparatus shown in the drawings is an apparatus for the manufacture of a cable core unit from 25 pairs of insulated electrical conductors (or wires as referred to in this description). The wires in each pair are stranded together before pairs are themselves combined and bound with binding tape to form the core unit. The core unit may be intended to form a complete cable core, or a core may be made from a plurality of such units.

This apparatus is constructed in the manner described in copending patent application Ser. No. 413,175 in the names of John Nicholas Garner, Jean Marc Roberge and Oleg Axiuk filed concurrently with this present application and entitled "Forming Cable Core Units".

As described in the aforementioned application, the apparatus comprises a plurality of wire guide means, one for each pair of conductors. Each guide means is in the form of two guide tubes 10, extending one alongside the other, from a tube support plate 12 at their upstream ends to a twisting station at their downstream ends. Each tube is individually rotatably mounted about its own axis by its upstream end within the plate support which is, in turn, spring urged upon parallel guides 14 towards a fixed frame member 16. As will be described, the tubes are rotationally flexible for the purpose of withstanding rotational forces involved when downstream ends of the tubes are rotated relative to upstream ends and each at its twisting station, around a longitudinal axis located substantially symmetrically between the tubes. This rotation is alternately in one direction and then the other from an equilibrium position in which the tubes are untwisted and lie parallel as shown in FIG. 1. The tubes are formed from a material which provides this rotational flexibility and may be made, for instance, from stainless steel or an acetal homopolymer, as sold under the trademark "DELRIN".

The construction of each guide means, and its method of mounting to the frame member 16 are described in detail in Patent application Ser. No. 413,179, filed concurrently with this present application in the names of John Nicholas Garner and Jean Marc Roberge and entitled "Stranding Wires". A direction changing means 18 is provided for each twisting means (to be described) guide means as shown by FIG. 1. This changing means comprises a magnetic switch means which is triggered by an interrupter arm as described in copending patent application Ser. No. 413,178, filed concurrently with this present application in the names of John Nicholas Garner, Jean Marc Roberge and Norbert Meilenner and entitled "Apparatus for Stranding Wire". As also described in that specification, each changing means 18 is located a short distance from its associated plate support 12.

As described in patent application Ser. No. 413,175, filed concurrently with this present application and entitled "Forming Cable Core Units" referred to above, the twenty-five guide means thus included in the apparatus are arranged in specific manner and there are three twisting stations for three groups of the guide means. In fact, all of the guide means are located by the frame member 16 and other frame members around three pitch circles which are concentric around a common axis 20 as shown by FIG. 1. As described in the application "Forming Cable Core Units", three guide means are located upon an innermost pitch circle by the positions of their plate supports 12 which are equally spaced around the common axis 20. The tubes of these three guide means extend for approximately 65 feet to the first twisting station 22 at which a twisting means 24 for each of the three guide means is held by a pair of spaced parallel frame members 26, the twisting means being in corresponding positions to the associated plate supports 14 whereby the guide means extend substantially parallel with the axis 20. One of the three innermost guide means is superposed by another guide means in FIG. 1 so that only two, together with their twisting means, are shown.

Around an intermediate pitch circle, nine guide means are disposed, in the same manner discussed in the last paragraph, these nine guide means being equally spaced apart around the axis 20 and terminating, each at a twisting means 28, in a twisting station 30 at a pair of spaced parallel frame members 32. The remaining thirteen guide means are disposed around an outermost pitch circle and these guide means terminate at a twisting station 34, in twisting means 36, held between spaced parallel frame members 38. Only two of the guide means and their respective twisting means are shown, for reasons of clarity, at each of the stations 30 and 34. Each guide means terminating at twisting stations 30 and 34, passes through either a clearance hole in each upstream frame 26 or in each frame 26 and 32, or alternatively, the guide means passes through a bearing 40 in each frame as shown by FIG. 1.

Each twisting means 24, 28, and 36 comprises a cylinder 42 formed with two holes (not shown) within which the downstream ends of the two tubes are secured. Two annular electric clutches 44 and 46 have their driven sides secured to the cylinder 42 for driving it alternately in opposite directions. All clutches 44 and 46 are radially aligned into two groups between the frames of each pair 26, 32 and 38 and the clutches in each group are driven by a common drive belt 48 or 50. The drive belts 48 and 50 at each twisting station are driven continuously, each in one direction, around pulley wheels 52, 54 secured to two drive shafts 56 (which are in line in FIG. 1). The drive shafts are driven by a single electric motor 58.

Downstream of each twisting means 24, 28, a single tube 60 extends, the tube being secured to its cylinder 42 and extending to a downstream end held by a bearing 62 in a frame 64 lying immediately downstream from the twisting station 34. These tubes 60 are torsionally rigid, i.e. as they rotate with their twisting means, they do not torsionally twist as does each guide means. Each tube 60 is formed from metal or rigid plastic. The tubes 60 pass through central apertures 66 of frames 32 and 38 through which they pass towards frame 64.

Each of the guide means and tubes 60 leading to the frame 64, or in the case of the guide means terminating in the twisting means 36, is to be used to enable each of its wires 68 to be given a degree of twist by the twisting means while the tubes prevent the wires from twisting together. The pitch circle for the twisting means 36 is at a diameter only sufficient to allow all of the guide means and twisting means to be passed between and held by the various frames while being suitably drivably connected to the motor 58 without any interference between one twisting means and its guide means and another. Nevertheless, for stranding together twenty-five pairs of wires, the diameter of the outermost pitch circle is approximately 20 inches. However, it is required that the apparatus should provide a cable core unit 72 from these wires. This involves the bringing together of all of the stranded wire units. To prevent the stranded wire units time to develop a significant unstranding action before being formed into the core unit 72, it is essential that a stranding station 74 is immediately at a position upstream of a core unit forming station 76. Hence, some means is required to more closely group the unstranded wires together at the stranding station where stranding into the wire units is then accomplished.

According to this invention, for this purpose, and as shown by this embodiment, the apparatus comprises strand prevention means which follow and maintain converging curved paths although they are caused to rotate in alternating directions together with the twisting means. These curved paths direct the twenty-five parallel paths for the wires of the pairs onto a single path which is coincident with the axis 20 at the station 76.

As shown by FIG. 1, each strand prevention means comprises a wire separation tube 78. In the case of the each tube 60 terminating at frame 64, the paths for the wires of each pair to be stranded are continued by a separation tube 78 which passes through bearings 80 in a support frame 82 and terminates at a support frame 84 which is disposed immediately upstream of the stranding station 74. These tubes 78 are secured to the tubes 60 so as to rotate with them. Wire separation tubes 78 are also secured to and extend from the cylinders 42 of twisting means 36, and these tubes 78 pass through clearance holes (not shown) in the frame 64, which lies close to the cylinders 42, and then proceed through bearings 80 to terminate at frame 84. The tubes converge as they pass through frame 82 to frame 84 and each tube is held upon its curved path by the frames.

Clearly, each tube is required to rotate around its axis which coincides with its fixed curved path section and must have sufficient flexibility to be maintained in this curved configuration while enduring alternating compressive and tensile stresses to give a satisfactory working life. Each tube 78 also has torsional rigidity to prevent it from twisting thereby avoiding build-up and retention of twist. The tubes 78 of this embodiment are formed from an acetal homopolymer, as sold under the trademark "DELRIN", and have an outside diameter of 0.22 inches and an inside diameter of 0.075 inches. These tubes pass through the frame 82 to frame 84 at pitch circle diameters which, while decreasing, still maintain the relative positions of the tubes at frame 84. Although the outermost pitch circle diameter is reduced from around 20 inches at frame 64 to approximately 8 inches over a distance of approximately 20 inches along the axis 20, these tubes satisfactorily withstand the stresses involved. Another suitable material is stainless steel.

Figure 2:
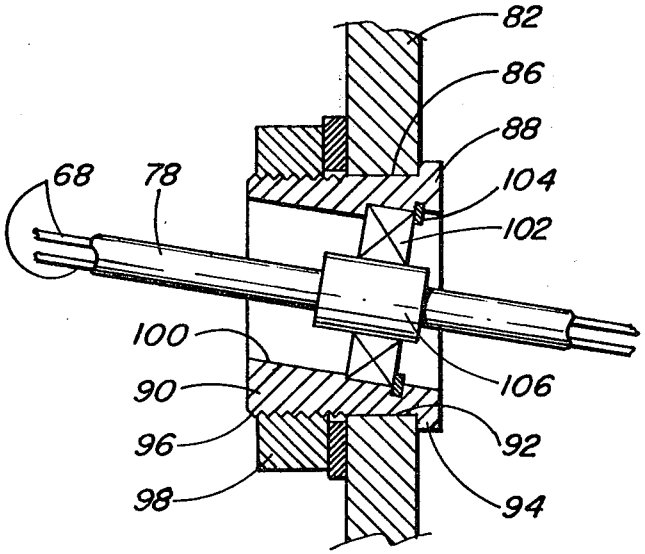
FIG. 2 is a cross-sectional view through part of the apparatus of FIG. 1 and shown in larger scale.

As shown by FIG. 2, the frame 82 necessarily lies at an angle to the direction of each tube 78 passing through it. This angle depends upon which pitch circle the tube is disposed. To avoid the need to provide holes in the frame 82 drilled at the different angles required, each hole 86 is formed normal to the frame and an adjustable fitting 88 is located within the hole to provide the desired angle. All the fittings 88 are of similar construction and comprise a substantially cylindrical member 90 having a smooth surface portion 92 for sliding reception within its frame hole 86. One end of the portion 92 terminates in a larger diameter shoulder 94 to engage one side of the frame. The other end of portion 92 extends as a screw thread 96 to accommodate a holding nut 98 to assemble it to the frame. The member 90 has a stepped bore 100 which, as shown, is inclined to the axis of the member and this angle is dependent upon whichever pitch circle position the fitting is used. A bearing 102 held against a shoulder within the bore by a resilient clip 104, grips a steel sleeve 106 which is glued to or is a press fit with the surface of the tube 78 passing through the bearing. As may be seen, the fitting 88 is rotatable in each case, within the frame 82 to adjust the inclination of the bore 100 to the desired smoothly curved path of its tube 78 +h fitting then being secured in position.

Figure 3:
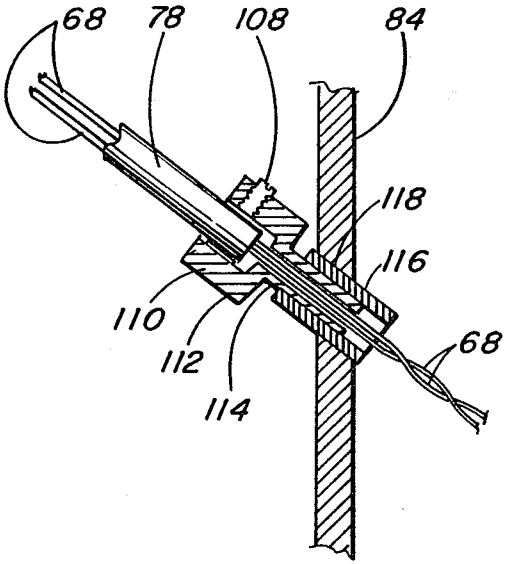
FIG. 3 is a view similar to FIG. 2 of another part of the apparatus.

As shown by FIG. 3, the downstream end of each tube 78 is secured by a locking screw 108 within an end 110 of a cylindrical fitting 112. This fitting has a reduced diameter portion 114 having a passage sufficient for two wires 68 issuing from the end of tube 78. This portion 114 is rotatably received within a short metal cylinder 116 extending through a hole 118 formed in frame 84 at the required angle.

Figure 4:
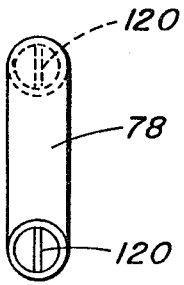
FIG. 4 is a diagrammatic end view of a wire separation tube used in the apparatus.

Each of the separation tubes 78 has two feedpath separation means spaced apart along it to separate the feedpaths for the two wires which are to pass through it. Each of the separation means comprises a pin 120, as shown in FIG. 4, which is a diagrammatic view of the whole length of one of the tubes and indicates the positions of the two pins which are disposed at its ends.

In use of the apparatus described above, each of the twisting means is rotated continuously in alternating directions for a preset number of revolutions (e.g. 35 revolutions to each side of an untwisted position of the guide tubes as shown by FIG. 1). The downstream end of the associated guide tubes 20 rotate with the twisting means to place torsional twist on the tubes first in one direction and then the other about a longitudinal axis. The alternate rotation of the twisting means is effected by the direction changing means 28 which alternately operates the clutches 44 and 46. The wires 80 are passed through the tubes 20 which prevent the wires from twisting together as the wires move towards the twisting means. The wires pass through the twisting means 36, 38 or 40.

Upon the wires for each pair passing through its twisting means 24 and 28, the wires immediately pass from the two tubes 10 into a respective tube 60. These wires then proceed into their separation tubes 78. In each tube 78, the two wires 68 for each pair are fed one either side of each of the pins 120 which thus prevent the wires from stranding together under the action of the twisting means while in the tube 78. The pins 120 also prevent the wires from stranding together during their movement along the tubes 60. The pins 120 in tubes 78 leading from the twisting means 36, also prevent stranding of the wires in these tubes. Further, the tubes 78 rotate around the curved paths of their axes while leading the wires along converging paths whereby when the wires issue from the tubes 78, the wires immediately strand together to form the pairs, the pairs then being adjacent one another and moving into the cable core unit forming station 76. This station is sufficiently close to the stranding station 74 to preclude any substantial untwisting of the wires of each pair before the pairs come together as the core unit whereupon any unwinding action is resisted by virtue of their frictional contact.

The core unit forming station does, in practice, include a device for holding the wire pairs in the form of the core unit. For this purpose, a conventional binding head 122 may be used having a spool 124 of tape which wraps tape 126 around the core unit as it emerges from the head.

The above apparatus and according to the invention thus enables a core unit to be formed from pairs of wires which have been stranded together with a rotatable twisting means and a torsionally twistable wire guide means with negligible unwinding of the wires in each pair. Because of the physical need to twist the wires of all the pairs in spaced positions, the twisting means are also necessarily spaced and if stranding of the pairs were allowed to take place immediately upon exiting from the twisting means, then uncontrollable unwinding would occur before convergence of the stranded pairs at the core unit forming station. By the use of the flexible but torsionally rigid wire separation tubes according to the invention, this problem is overcome by delaying of the stranding of wires into their pairs until they lie closely adjacent to one another and are positioned for movement directly into the core unit forming station.

In a modification of the above embodiment (not shown), each guide means in the form of two tubes 10 is replaced by a guide means comprising a single tube defining a single axial passage which provides at least two side-by-side feedpaths for wire. The passage is shaped to prevent wires from moving across the passage to interchange positions by having a narrow passage region in between wider regions which provide the feed paths. Such guide means is disclosed in copending patent application Ser. No. 413,069, filed concurrently with this patent application in the names of John Nicholas Garner, Jean Marc Roberge and Douglas Baxter and entitled "Apparatus For Stranding Wire".

What is claimed is:

1. Apparatus for stranding a unit of at least two wires together comprising:

wire guide means extending in a wire pass direction, downstream to a twisting station to define individual feed paths for wires and prevent the wires from twisting together as they move along the guide means to the twisting station, the guide means being rotatably flexible about a longitudinal axis to provide torsional twist in the guide means;

a twisting means in the twisting station and connected to the wire guide means, the twisting means having means to rotate it alternately, in one direction and then the other and for a plurality of revolutions, to rotate the guide means at the twisting station and place torsional twist in the guide means alternately in one direction and then the other about said longitudinal axis;

a stranding means in a stranding station downstream along the feedpaths from the twisting station with at least a section of the feedpaths for wires being curved and of fixed orientation between the twisting and stranding stations; and means extending between the twisting and stranding stations to prevent the wires, after passage through the twisting means, from stranding together before they reach the stranding station, said strand prevention means comprising a wire separation tube which is curved to extend along the fixed curved section of path and defines the individual feed paths for the wires, said separation tube being rotatable around an axis of rotation which coincides with the fixed curved path section and with a speed and direction of rotation the same as the twisting means, and the tube having flexibility to enable the tube to be maintained in its curved configuration along said fixed curved path section and torsional rigidity to avoid build-up and retention of twist.

2. Apparatus according to claim 1, having at least one wire separation tube support frame and wherein the wire separation tube passes through and is mounted by a bearing within the frame to ensure that the tube follows the curved section of path with fixed orientation.

3. Apparatus according to claim 2, wherein the frame lies at an angle to the direction of the tube at the position at which the tube passes through the frame and the bearing is inclined to the angle of the frame.

4. Apparatus according to either of claims 1 and 2, wherein the separation tube has feedpath separation means spaced apart along the tube to separate the feedpaths at the locations of said means.

5. Apparatus according to either claims 1 and 2, wherein the separation tube has two feedpath separation means disposed one within each end portion of the tube.

6. Apparatus for stranding together a plurality of units of wires, each unit comprising at least two wires twisted together, said apparatus comprising a plurality of apparatus according to claim 1, with the twisting means for the different units being spaced apart, the wire separation tubes each curving along its own fixed curved section of path with the paths converging towards each other and having downstream ends adjacent to one another to locate all of the twisted wires in adjacent positions as the units are formed at the stranding station to enable the wire units to be stranded together; and a core unit forming station immediately downstream of the stranding station to combine the wire units into a core unit.

7. Apparatus according to claim 6, wherein the twisting means are positioned around a main axis and the stranding means is located upon said main axis.

8. Apparatus according to claim 6, having at least one separation tube support frame disposed between the twisting and the stranding stations and the wire separation tubes pass through and are mounted individually within the frame in bearings to ensure that the tubes follow the curved section of path with fixed orientation.

9. Apparatus according to claim 6, having at least one separation tube support frame disposed between the twisting and stranding stations in a position substantially normal to said main axis and the wire separation tubes pass through and are mounted individually within the frame in bearings to ensure that the tubes follows the curved section of path with fixed orientation.

* * * * *